US010559154B2

(12) United States Patent
Wilkinson et al.

(10) Patent No.: US 10,559,154 B2
(45) Date of Patent: Feb. 11, 2020

(54) SMART LOCKER

(71) Applicant: Walmart Apollo, LLC, Bentonville, AR (US)

(72) Inventors: Bruce W. Wilkinson, Rogers, AR (US); Todd Davenport Mattingly, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/831,693

(22) Filed: Dec. 5, 2017

(65) Prior Publication Data

US 2018/0165902 A1 Jun. 14, 2018

Related U.S. Application Data

(60) Provisional application No. 62/434,121, filed on Dec. 14, 2016.

(51) Int. Cl.

| | |
|---|---|
| ***A45C 5/14*** | (2006.01) |
| ***G07C 9/00*** | (2020.01) |
| ***B65D 81/38*** | (2006.01) |
| ***F25D 23/06*** | (2006.01) |

(Continued)

(52) U.S. Cl.

CPC ..... *G07C 9/00896* (2013.01); *A45C 5/145* (2013.01); *A47B 31/02* (2013.01); *B65D 81/3813* (2013.01); *E05G 1/005* (2013.01); *F25D 19/00* (2013.01); *F25D 19/003* (2013.01); *F25D 23/06* (2013.01); *F25D 23/069* (2013.01); *G07C 9/00* (2013.01); *G07C 9/00309* (2013.01);

(Continued)

(58) Field of Classification Search

CPC ..... A45C 13/24; A45C 15/00; A45C 5/145; A47B 31/02; B62B 5/06; B62B 1/002; B62B 1/14; B62B 3/002; B62B 3/003; B62B 3/1404; B62B 3/1416; B62B 3/146; B62B 5/00; B62B 5/0083; B62B 5/067; E05B 47/00; E05G 1/005

See application file for complete search history.

(56) References Cited

U.S. PATENT DOCUMENTS

| | | | |
|---|---|---|---|
| 3,898,854 | A | 8/1975 | McSheehy et al. |
| 4,983,089 | A | 1/1991 | Rose |

(Continued)

OTHER PUBLICATIONS

International Search Report and Written Opinion for Application No. PCT/US2017/064640, dated Feb. 9, 2018. 13 pages.

*Primary Examiner* — Benyam Haile

(74) *Attorney, Agent, or Firm* — McCarter & English, LLP; David R. Burns

(57) ABSTRACT

An example portable container is described. The example portable container includes a body, a handle, a pair of wheels, a wheel lock, and an authenticator. The body includes walls that form an inner chamber configured and dimensioned to receive one or more items. The handle is mounted to the body, and the pair of wheels is mounted to the body. The wheel lock is configured to selectively engage and disengage at least one wheel of the pair of wheels. Engagement of the at least one wheel with the wheel lock restricts rotation of the wheel. The authenticator is configured to authenticate a user for transporting the portable container. If the authenticator fails to authenticate the user, the wheel lock is actuated to engage the at least one wheel of the pair of wheels to restrict rotation of the wheel.

14 Claims, 5 Drawing Sheets

(51) Int. Cl.

| | |
|---|---|
| ***E05G 1/00*** | (2006.01) |
| ***F25D 19/00*** | (2006.01) |
| ***A47B 31/02*** | (2006.01) |
| *F25D 29/00* | (2006.01) |

(52) U.S. Cl.
CPC ..... *G07C 9/00912* (2013.01); *G07C 9/00944* (2013.01); *F25D 29/003* (2013.01); *F25D 2331/804* (2013.01); *F25D 2400/38* (2013.01); *G07C 2009/0092* (2013.01); *G07C 2009/00769* (2013.01)

(56) References Cited

U.S. PATENT DOCUMENTS

| | | | | |
|---|---|---|---|---|
| 6,692,011 | B2 | 2/2004 | Carlson et al. | |
| 6,983,946 | B2 | 1/2006 | Sullivan et al. | |
| 7,111,853 | B2 | 9/2006 | Tracewell et al. | |
| 2006/0264120 | A1 | 11/2006 | Perrier et al. | |
| 2011/0067967 | A1* | 3/2011 | Herrera | A45C 5/145 190/18 A |
| 2012/0194043 | A1 | 8/2012 | Turner et al. | |
| 2014/0152238 | A1 | 6/2014 | Racenet et al. | |
| 2014/0291976 | A1 | 10/2014 | Ford et al. | |
| 2014/0326744 | A1 | 11/2014 | Ratnakar | |
| 2015/0041100 | A1* | 2/2015 | Huang | B64D 11/0007 165/42 |
| 2016/0185375 | A1 | 6/2016 | Yu et al. | |
| 2016/0255928 | A1* | 9/2016 | O'Donnell | A45C 5/03 |
| 2016/0270527 | A1 | 9/2016 | Winter | |
| 2017/0084107 | A1* | 3/2017 | Homer | G07F 17/3209 |
| 2017/0188679 | A1* | 7/2017 | Jacob | H04W 76/10 |
| 2017/0220040 | A1* | 8/2017 | London | G05D 1/0088 |
| 2018/0057341 | A1* | 3/2018 | Kincaid | B67D 1/0418 |

* cited by examiner

SMART LOCKER

CROSS-REFERENCE TO RELATED APPLICATIONS

This application claims the benefit of commonly assigned U.S. Provisional Patent Application No. 62/434,121, which was filed on Dec. 14, 2016. The entire content of the foregoing provisional patent application is incorporated herein by reference.

BACKGROUND

Securing items during transport from one location to another location can be difficult for those without a vehicle. Depending on the distance from the retailer, the act of transporting the items can be physically demanding and frozen items can melt or defrost along the way.

SUMMARY

Exemplary embodiments of the present disclosure provide a portable container (e.g., a smart locker) that receives items for transport and includes wheels to assist in transporting the items to a desired location. The portable container includes an authenticator configured to authenticate the user, thereby providing a security feature that ensures that the correct user is transporting the items. The portable container can include a temperature control system for maintaining a predetermined or customized temperature within the portable container. The temperature control system allows the user to transport frozen items with minimal or no defrosting/melting. The wheels of the portable container can be powered to assist in transporting the portable container to the desired location.

In accordance with embodiments of the present disclosure, an exemplary portable container (e.g., smart locker) is provided. The portable container includes a body, a handle, a pair of wheels, a wheel lock, and an authenticator. The body includes walls that form an inner chamber configured and dimensioned to receive one or more items. The handle is mounted to the body, and the pair of wheels is mounted to the body. The wheel lock can be configured to selectively engage and disengage at least one wheel of the pair of wheels. Engagement of the at least one wheel with the wheel lock substantially restricts rotation of the wheel. The authenticator can be configured to authenticate a user for transporting the portable container. If the authenticator fails to authenticate the user, the wheel lock can be actuated to engage the at least one wheel of the pair of wheels to restrict rotation of the wheel.

The portable container can include a second pairs of wheels mounted to the body. The wheel lock can include a brake configured to selectively engage and disengage the at least one wheel of the pair of wheels. The handle mounted to the body can be, e.g., a retractable handle, a telescoping handle, or the like. The handle can be configured to be positioned in a stored position and an extended position. For example, the handle can be retracted into a storage compartment when in the stored position. As a further example, the handle can be extended from the storage compartment when in the extended position.

In some embodiments, the authenticator can be disposed on the handle and includes a fingerprint scanner configured to authenticate the user by scanning one or more fingerprints of the user. In some embodiments, the authenticator can include a proximity sensor configured to detect a proximity of the user relative to the portable container. In some embodiments, the proximity sensor can be configured to detect the proximity of a handheld device of the user relative to the portable container.

The portable container includes a temperature control system configured to regulate a temperature within the inner chamber. The portable container includes a power source configured to rotationally power the pair of wheels. In some embodiments, the portable container can include an actuator for selectively rotationally powering the pair of wheels with the power source. In some embodiments, the pair of wheels can be automatically rotationally powered by the power source upon successful authentication of the user with the authenticator.

In accordance with embodiments of the present disclosure, an exemplary portable container system (e.g., smart locker system) is provided that includes a portable container (e.g., smart locker). The portable container includes a body, a handle, a pair of wheels, a wheel lock, and an authenticator. The body includes walls that form an inner chamber configured and dimensioned to receive one or more items. The handle is mounted to the body, and the pair of wheels is mounted to the body. The wheel lock can be configured to selectively engage and disengage at least one wheel of the pair of wheels. Engagement of the at least one wheel with the wheel lock restricting rotation of the wheel. The authenticator can be configured to authenticate a user for transporting the portable container. If the authenticator fails to authenticate the user, the wheel lock can be actuated to engage the at least one wheel of the pair of wheels to restrict rotation of the wheel. The system includes one or more docking stations including a docking section configured to engage the portable container.

The docking station can include a power source configured to provide power to a battery of the portable container. The docking station can include a temperature control system configured to regulate a temperature within the inner chamber of the portable container while the portable container is engaged with the docking section. In some embodiments, the system can include a reservation engine executed by a processing device to permit the user to reserve the portable container (e.g., via a portable handheld device, a graphical user interface provided at the docking station, or the like). In some embodiments, the authenticator can perform authentication of the user based on information input by the user into the reservation engine via a graphical user interface. For example, when reserving the portable container via the reservation engine, the user can input thumbprint information via the graphical user interface and the authenticator can compare the input thumbprint to the scanned thumbprint to authenticate the user.

In accordance with embodiments of the present disclosure, an exemplary method of transporting items is provided. The method includes providing a portable container (e.g., a smart locker). The portable container includes a body, a handle, a pair of wheels, a wheel lock, and an authenticator. The body includes walls that form an inner chamber. The handle is mounted to the body, and the pair of wheels is mounted to the body. The wheel lock can be configured to selectively engage and disengage at least one wheel of the pair of wheels. Engagement of the at least one wheel with the wheel lock restricts rotation of the wheel. The authenticator can be configured to authenticate a user for transporting the portable container. The method includes placing one or more items within the inner chamber of the portable container. The method includes authenticating the user via the authenticator to transport the portable container. If the authenticator fails to authenticate the user, the wheel lock can be actuated to engage the at least one wheel of the pair of wheels to restrict rotation of the wheel.

In some embodiments, the authenticator can be disposed on the handle and includes a fingerprint scanner. In such embodiments, the method can include authenticating the user by scanning one or more fingerprints of the user with the fingerprint scanner. In some embodiments, the authenticator can include a proximity sensor. In such embodiments, the method can include authenticating the user by detecting a proximity of the user relative to the portable container.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the portable containers, reference is made to the accompanying figures, wherein.

DETAILED DESCRIPTION

It should be understood that the relative terminology used herein, such as "front", "rear", "left", "top", "bottom", "vertical", "horizontal", "up" and "down" is solely for the purposes of clarity and designation and is not intended to limit embodiments to a particular position and/or orientation. Accordingly, such relative terminology should not be construed to limit the scope of the present disclosure. In addition, it should be understood that the scope of the present disclosure is not limited to embodiments having specific dimensions. Thus, any dimensions provided herein are merely for an exemplary purpose and are not intended to limit the invention to embodiments having particular dimensions.

Exemplary embodiments of the present disclosure provide a portable container that receives one or more items and includes wheels to assist in transporting the items to a desired location. The wheels of the portable container can be powered to assist in transporting the portable container to the desired location. In some embodiments, the amount of power or speed of rotation of the wheels can be varied by the user via controls provided on the portable container depending on the terrain. The portable container includes an authenticator configured to authenticate the user, thereby providing a security feature that ensures that the correct user is transporting the items. The portable container can include a temperature control system for maintaining a predetermined or customized temperature within the portable container. The temperature control system allows the user to transport frozen items with minimal or no defrosting/melting, or hot items with minimal or no cooling.

Figure 1:
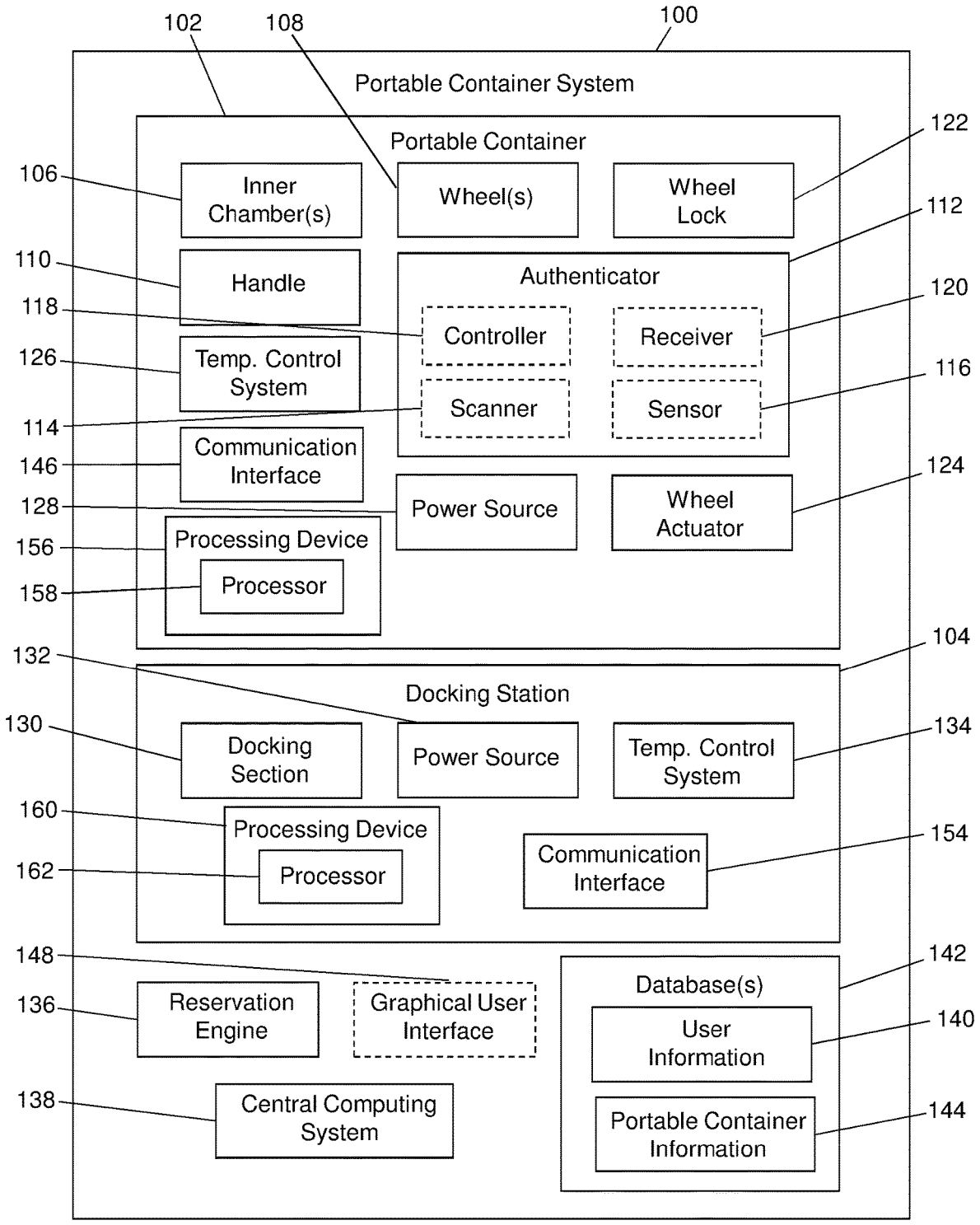
FIG. 1 is a block diagram of an exemplary portable container system of the present disclosure.

FIG. 1 is a block diagram of an exemplary portable container system 100 (hereinafter "system 100") of the present disclosure. The system 100 generally includes one or more portable containers 102 (e.g., smart lockers) and one or more docking stations 104. For example, one docking station 104 can be located at a retail establishment and additional docking stations 104 can be distributed in different locations of a geographic area, such as a city. A customer can disengage a portable container 102 from the docking station 102 at the retail establishment to position one or more items within the portable container 102 for transport to the customer's residence, thereby preventing frozen or cold items from melting/defrosting. After the items have been removed from the portable container 102 at the customer's residence, the portable container 102 can be returned and engaged with a docking station 104 in a location other than the retail establishment (e.g., a docking station 104 closest to the customer's residence).

Each portable container 102 includes one or more inner chambers 106. In one embodiment, the portable container 102 includes a single inner chamber 106 in which multiple items can be positioned. In one embodiment, the portable container 102 can include an inner space separated into multiple inner chambers 106 such that certain items can be separated from other items. As one non-limiting example, for embodiments having multiple inner chambers 106, each inner chamber can have a different temperature control/environment (e.g., a cold chamber, a hot chamber, an ambient chamber). The portable container 102 includes one or more pairs of wheels 108 (e.g., two pairs of wheels with each wheel located at a corner of the portable container 102 body) for rolling the portable container 102 along a surface.

The portable container 102 includes a handle 110 mounted to the body of the portable container 102. In one embodiment, the portable container 102 can include a storage compartment (e.g., an elongated opening) within the body of the portable container 102 into which the handle 110 can at least partially be inserted. For example, the handle 110 can be configured to be positioned in a stored position and an extended position. In the stored position, the handle 110 can be retracted into the storage compartment during non-use of the portable container 102. In the extended position, the handle 110 can be extended from the storage compartment and can be used to pull or push the portable container 102 along a surface. The handle 110 can be hingedly connected to the portable container 102 to allow for automatic adjustment of the angle of the handle 110 relative to the portable container 102 depending on the height of the user.

The portable container 102 includes an authenticator 112 configured to authenticate the user for transporting the portable container 102. In particular, as will be discussed in greater detail below, the authenticator 112 can be a security feature which detects the user of the portable container 102 and limits the ability of a different individual from attempting to take or steal the portable container 102. In one embodiment, the authenticator 112 includes a scanner 114 (e.g., a biometric identification scanner, a fingerprint or thumbprint scanner, retinal scanner, or the like) configured to authenticate the user by scanning one or more fingerprints or other attribute of the user (e.g., a retina). Although discussed herein as scanning fingerprints of the user, it should be understood that the scanner 114 can be used for any biometric identification (e.g., fingerprint, voice, retina, facial pattern, combinations thereof, or the like).

The scanner 114 can be located on the grip portion of the handle 110 such that when the user grips the handle 110 to transport the portable container 102, the authenticator 112 scans one or more fingerprints of the user to identify the user. The scanner 114 can be contoured or molded to wrap around the handle 110 such that when the user grips the handle one of the user's fingers can engage and wrap around the scanner 114. In one embodiment, the user can scan their fingerprint via the scanner 114 prior to using the portable container 102, and the authenticator 112 can compare subsequent scans of the fingerprint to the initial scan to ensure that the same user is controlling the portable container 102. If the scanned fingerprints match, the authenticator 112 determines that authentication has been successful. If the scanned fingerprints do not match, the authenticator 112 determines that authentication has failed and requests a rescan.

In some embodiments, the authenticator 112 includes a sensor 116 (e.g., a proximity sensor) configured to detect a proximity of the user and/or a user's handheld device relative to the portable container 102. As an example, if the sensor 116 detects the user or the user's handheld device within one foot of the handle 110, the authenticator 112 determines that authentication has been successful. As a further example, if the sensor 116 does not detect the user or the user's handheld device within one foot of the handle 110, the authenticator 112 determines that authentication has failed. In some embodiments, the portable container 102 can include multiple sensors 116 disposed around the portable container 102, thereby sensing the proximity of the user relative to the body of the portable container 102 and/or the handle 110. In some embodiments, the authenticator 112 can include both a scanner 114 and a sensor 116.

The authenticator 112 can include a controller 118 and a receiver 120. The receiver 120 can receive electronically transmitted data (e.g., the scanned fingerprint data detected by the scanner 114, the proximity data detected by the sensor 116, combinations thereof, or the like). Based on the received data and communication between the receiver 120 and the controller 118, the controller 118 can regulate one or more functions of the portable container 102. In particular, depending on whether authentication of the user is successful or not, the controller 118 can be actuated to regulate one or more functions of the portable container 102.

The portable container 102 includes one or more wheel locks 122 (e.g., brakes) associated with one or more wheels 108. The wheel lock 122 can be configured to selectively engage and disengage the wheel 108 to restrict rotation of the wheel 108. The wheel lock 122 can be engaged when the portable container 102 is in storage to prevent undesired movement of the portable container 102. In one embodiment, the wheel lock 122 can be engaged when the handle 110 is positioned in the stored position, and can be disengaged when the handle 110 is positioned in the extended position. In one embodiment, the wheel lock 122 can be automatically engaged to stop rotation of one or more wheels 108 when the authenticator 112 fails to authenticate the user.

Engagement of the wheels 108 acts as a safety feature to restrict undesired movement of the portable container 102 when the user is not in proximity of the portable container 102, and further acts as a security feature to prevent other individuals from taking the portable container 102. Thus, if successful authentication occurs via the authenticator 112, the receiver 120 transmits the successful authentication to the controller 118 and the controller 118 disengages the wheel lock 122 to allow for rotation of the wheels 108. If authentication fails, the receiver 120 transmits the failed authentication to the controller 118 and the controller 118 engages the wheel lock 122 to prevent rotation of the wheels 108. In some embodiments, the authentication step occurs once prior to use of the portable container 102.

In some embodiments, the authentication step occurs several times during use of the portable container 102 (e.g., before use, every five minutes during use, or the like). In some embodiments, the authentication step occurs continuously during use of the portable container 102 (e.g., the authenticator 112 attempts to authenticate the user substantially continuously after the portable container 102 has been disengaged from the docking station 104). In some embodiments, the portable container 102 can include an audible alarm output configured to output a signal if an individual other than the original user attempts to authenticate the authenticator 112. The alarm output acts as a security feature to prevent theft of the portable container 102. In some embodiments, the portable container 102 can output a global positioning system (GPS) signal to a central computing system 138 such that the system 100 knows the current location of each portable container 102 in substantially real-time.

In some embodiments, the portable container 102 can include a motor configured to rotationally drive the wheels 108. The motor assists the user in transporting the portable container 102 along different terrains. In one embodiment, upon successful authentication of the user, the controller 118 can transmit a signal to the motor to automatically rotationally drive the wheels 108. In one embodiment, the portable container 102 can include a wheel actuator 124 for selectively rotationally powering the wheels 108. The actuator 124 can be in the form of a switch or button on the handle 110 and/or the body of the portable container 102 that allows the user to selectively power rotation of the wheels 108. In some embodiments, the actuator 124 can be used to change the speed and/or direction of rotation of the wheels 108. In some embodiments, the actuator 124 can be used in combination with automatic powering of the wheels 108 after successful authentication, allowing the user to vary the speed and/or direction of rotation of the wheels 108.

The portable container 102 can include a temperature control system 126 configured to regulate conditions, such as temperature, within the inner chamber 106. In some embodiments, the temperature control system 126 can include a heating system, a cooling system, combinations thereof, or the like. In some embodiments, the temperature control system 126 can independently regulate the conditions within the individual inner chambers 106, allowing for different conditions within the portable container 102. For example, the temperature control system 126 can maintain a cold environment in one inner chamber 106 for frozen items, and simultaneously maintains a hot or warm environment in another inner chamber 106 of the same portable container 100 for hot items.

In some embodiments, the temperature control system 126 maintains the same conditions across a single inner chamber 106 and/or multiple inner chambers 106. The portable container 102 can include a power source 128 (e.g., a rechargeable battery) providing power to the authenticator 112, wheel actuator 124, temperature control system 126, motor, combinations thereof, or the like. In one embodiment, the portable container 102 can include one or more universal serial bus (USB) ports connected to the power source 128 such that one or more electronic devices of the user can be charged via the power source 128. In one embodiment, rotation of the wheels 108 can be converted into electricity to assist in charging the power source 128.

The docking station 104 can include a docking section 130 configured and dimensioned to engage a complementary section of the portable container 102. The docking section 130 can interlock the portable container 102 and acts as a security feature to prevent theft of the portable container 102. The docking station 104 can include a plurality of docking sections 130 (e.g., a row of docking sections 130) such that multiple portable containers 102 can be engaged with the docking station 104. In some embodiments, the portable containers 102 can be stacked or nested relative to each other and the docking section 130 can be configured to dispense or release a single portable container 102 at a time.

The docking station 104 can include a power source 132 configured to provide power to the power source 128 of the portable container 102. For example, the power source 132 can charge the power source 128 while the portable container 102 is engaged with the docking section 130. The docking station 104 can include a temperature control system 134 configured to regulate conditions, such as the temperature, within the portable containers 102 engaged with the docking section 130. For example, the temperature control system 134 can blow cool or hot air directly into the inner chamber 106, or powers the temperature control system 126.

In one embodiment, the portable container 102 does not include a temperature control system 126 and the temperature control system 134 regulates the conditions within the portable container 102 such that when the user disengages the portable container 102 from the docking section 130, the desired conditions already exist in the inner chamber 106. In one embodiment, the portable container 102 includes the temperature control system 126 and the temperature control system 134 regulates the conditions within the portable container 102 while the portable container 102 is engaged with the docking section 130 to prevent excessive use of the power source 128 of the portable container 102. In such embodiments, upon disengagement of the portable container 102 from the docking section 130, the temperature control system 126 can be actuated to maintain the conditions within the inner chamber 106.

The system 100 can include a reservation engine 136 that can be executed to reserve a specific portable container 102 at the time of use or prior to arriving at a docking station 104. For example, the user can access the reservation engine 136 via a graphical user interface (GUI) 148 on a remote device (e.g., a computer, a portable device, or the like) in communication with a central computing system 138. The user can input information related to the user, such as the name, address, payment information (if any), scanned fingerprint, unique identification number for portable device, and desired location for pick-up of the portable container 102, via the reservation engine 136. Such input information can be electronically stored in the user information 140 of a database 142 of the system 100. The reservation engine 136 and/or the central computing system 138 can receive the user information 140 and, based on the desired location for pick-up, assigns a portable container 102 the specific user. Information related to the portable containers 102 can be electronically stored in portable container information 144 of the database 142, and includes the portable container size, availability, unique identification number, history of use, or the like.

In some embodiments, a communication interface can provide electronic communication and transmission of data between the user device, the reservation engine 136, the central computing system 138, the portable container 102, and the docking station 132. For example, the portable container 102 can include a communication interface 146 that provides electronic communication and transmission of data between the portable container 102 and the user device, the reservation engine 136, the central computing system 138, and the docking station 132. As a further example, the docking station 104 can include a communication interface 154 that provides electronic communication and transmission of data between the docking station 104 and the user device, the reservation engine 136, the central computing system 138, and the portable container 102.

In some embodiments, the system 100 can include a processing device including a processor for executing one or more portions of the system 100 (e.g., the communication interfaces 146, 154, the reservation engine 136, or the like). In one embodiment, the portable container 102 can include a processing device 156 including a processor 158 for executing one or more portions of the portable container 102 (e.g., the communication interface 146, the authenticator 112, the temperature control system 126, or the like). In one embodiment, the docking station 104 can include a processing device 160 including a processor 162 for executing one or more portions of the docking station 104 (e.g., the communication interface 154, the temperature control system 134, or the like). In some embodiments, the GUI 148 can be located on the docking station 104 such that the user can reserve a portable container 102 at the docking station 104.

After the portable container 102 has been reserved via the reservation engine 136, the user can locate the portable container 102 corresponding with the unique identification number of the portable container 102 assigned to the user. Using the scanner 114 of the authenticator 112, the fingerprint of the user can be scanned to authenticate the user and disengage the portable container 102 from the docking station 104. Similarly, using the sensor 116 of the authenticator 112, the unique identification number of the portable device of the user can be sensed to authenticate the user and disengage the portable container 102 from the docking station 104. Once disengaged, the user can fill the portable container 102 with one or more items for transport to the user's residence. The portable container 102 can be returned to any docking station 104 after use.

Figure 2:
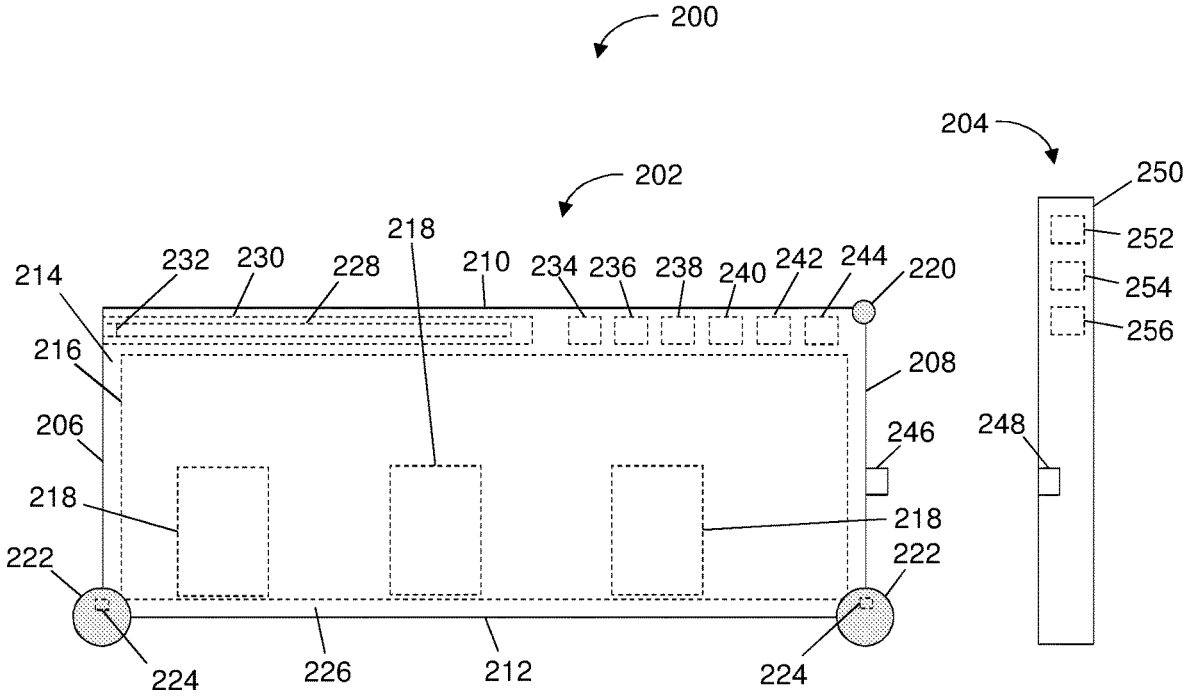
FIG. 2 is a diagrammatic side view of an exemplary portable container system of the present disclosure.

FIG. 2 is a diagrammatic side view of an exemplary portable container system 200 (hereinafter "system 200") including a portable container 202 and a docking station 204. The portable container 202 includes a body with a front wall 206, a rear wall 208, a top wall 210, a bottom wall 212, and side walls 214. The walls 206-214 form an inner enclosure or chamber 216 configured and dimensioned to receive one or more items 218. In one embodiment, at least a portion of the top wall 210 can be connected to the rear wall 208 (or another wall) via a hinge 220, thereby allowing the top wall 210 to act as a lid for opening and closing the chamber 216. In one embodiment, at least a portion of the top wall 210 can be slidably engaged with the side walls 214 to allow the top wall 210 to slide between an open and closed position. The portable container 202 includes an insulated layer 226 between the outer surface and inner surface of the body to maintain the desired conditions within the chamber 216.

The portable container 202 includes wheels 222 with a wheel lock 224. In one embodiment, only some of the wheels 222 can include a wheel lock 224. The portable container 202 includes a handle 228 shown in the stored position of the storage compartment 230. The handle 228 can be at least partially retracted from the storage compartment 230 for use of the portable container 202. The proximal end of the handle 228 includes an authenticator 232. In embodiments where the authenticator 232 is a fingerprint scanner, the authenticator 232 can be solely located on the handle 228. In embodiments where the authenticator 232 is a proximity sensor, the authenticator 232 can be located in other areas of the portable container 202.

The portable container 202 can include a power source 234 for rotationally driving the wheels 222. The portable container 202 can include a wheel actuator 236 for selectively driving the wheels 222. The portable container 202 can include a temperature control system 238 for cooling and/or heating the chamber 216. The portable container 202 can include a GPS transmitter 240 for transmitting the position of the portable container 202 to a central computing system and/or the docking station 204. The portable container 202 can include an auditory output 242 for communicating information to the user (e.g., improper authentication, low battery, or the like) and/or for emitting an alarm if multiple improper authentications are attempted. The portable container 202 can include a communication interface 244 for electronically receiving/transmitting data (e.g., data transmitted from/to the docking station 204). In one embodiment, the communication interface 244 can include a radio frequency (RF) transceiver and related circuitry.

The portable container 202 can include a docking interface 246 configured and dimensioned to be complementary to a docking section 248 of the docking station 204. The docking interface 246 can be received by the docking section 248 to prevent unauthorized disengagement of the portable container 202 from the docking station 204. The docking station 204 can include a power source 250 configured to provide power to the power source 234 of the portable container 202 for recharging of the power source 234 while the portable container 202 is docked with the docking station 204. The docking station 204 can include a temperature control system 252 configured to regulate the conditions within the chamber 216 without using the temperature control system 238.

For example, rather than implementing the temperature control system 238 to regulate the conditions within the chamber 216 (e.g., powered by the power source 234), the temperature control system 252 of the docking station 204 can be fluidically connected with the chamber 216 to regulate the conditions within the chamber 216. In one embodiment, the docking station 204 can include a duct connected to a complementary opening in the portable container 202 to direct, e.g., cold air, warm air, or the like, directly into the chamber 216. The level of electricity within the power source 234 can thereby be maintained in preparation for use of the portable container 202 while the chamber 216 is cooled or heated. The docking station 204 can include a communication interface 254 for electronically receiving/transmitting data (e.g., data transmitted from/to the portable container 202). In one embodiment, the communication interface 254 can include a radio frequency (RF) transceiver and related circuitry. The docking station 204 can include a GUI 256 for input of information from the user (e.g., for executing the reservation engine).

Figure 3:
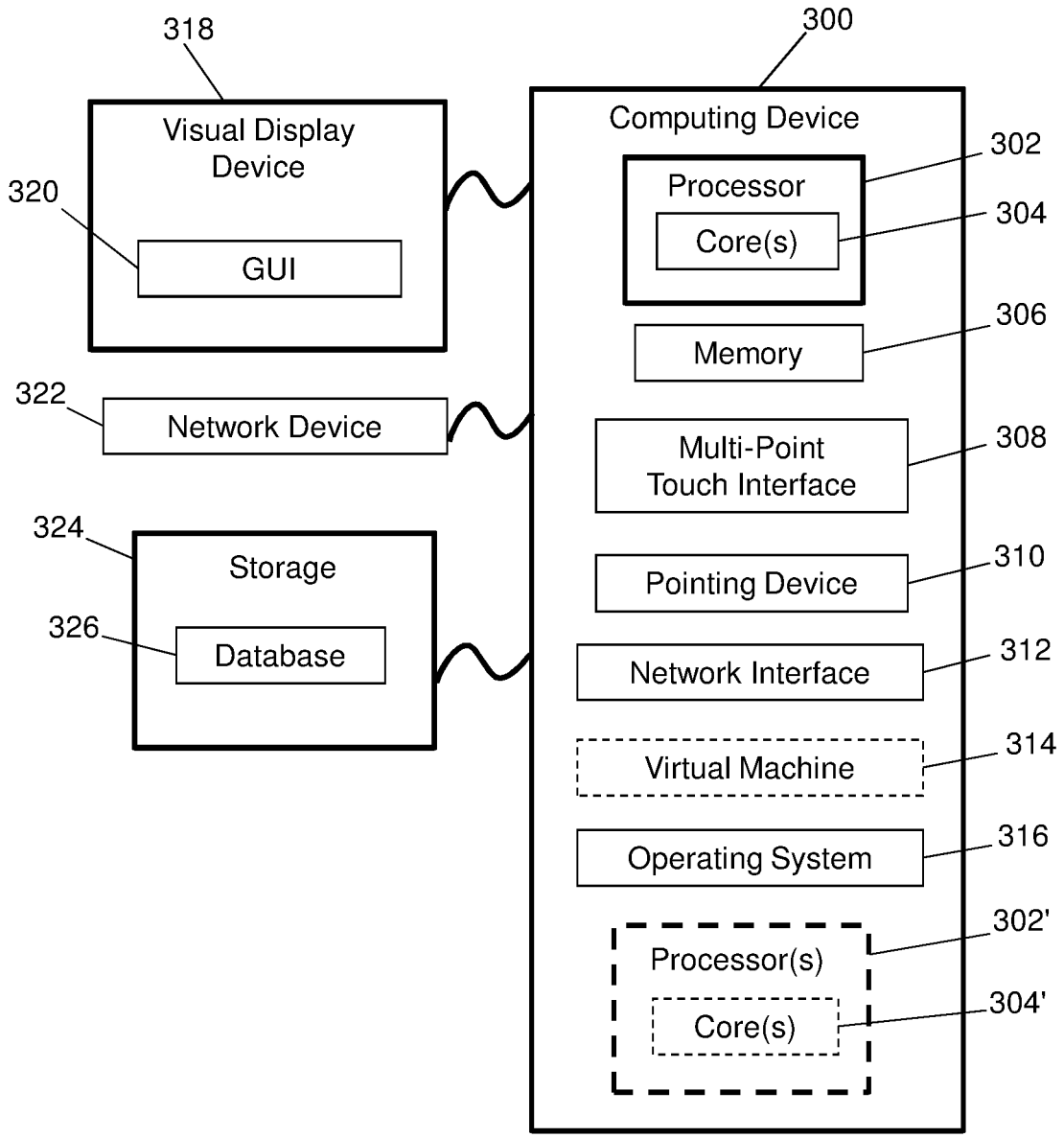
FIG. 3 is a block diagram of a computing device in accordance with exemplary embodiments of the present disclosure.

FIG. 3 is a block diagram of a computing device 300 in accordance with exemplary embodiments of the present disclosure. The computing device 300 includes one or more non-transitory computer-readable media for storing one or more computer-executable instructions or software for implementing exemplary embodiments. The non-transitory computer-readable media may include, but are not limited to, one or more types of hardware memory, non-transitory tangible media (for example, one or more magnetic storage disks, one or more optical disks, one or more flash drives), and the like. For example, memory 306 included in the computing device 300 may store computer-readable and computer-executable instructions or software for implementing exemplary embodiments of the present disclosure (e.g., instructions for operating the authenticator 112, instructions for operating the docking station 104, instructions for operating the communication interface 146, 154, instructions for operating the reservation engine 136, instructions for operating the central computing system 138, combinations thereof, or the like). The computing device 300 also includes configurable and/or programmable processor 302 and associated core 304, and optionally, one or more additional configurable and/or programmable processor(s) 302' and associated core(s) 304' (for example, in the case of computer systems having multiple processors/cores), for executing computer-readable and computer-executable instructions or software stored in the memory 306 and other programs for controlling system hardware. Processor 302 and processor(s) 302' may each be a single core processor or multiple core (304 and 304') processor.

Virtualization may be employed in the computing device 300 so that infrastructure and resources in the computing device 300 may be shared dynamically. A virtual machine 314 may be provided to handle a process running on multiple processors so that the process appears to be using only one computing resource rather than multiple computing resources. Multiple virtual machines may also be used with one processor. Memory 306 may include a computer system memory or random access memory, such as DRAM, SRAM, EDO RAM, and the like. Memory 306 may include other types of memory as well, or combinations thereof.

A user may interact with the computing device 300 through a visual display device 318 (e.g., a personal computer, a mobile smart device, or the like), such as a computer monitor, which may display one or more user interfaces 320 (e.g., GUI 148) that may be provided in accordance with exemplary embodiments. The computing device 300 may include other I/O devices for receiving input from a user, for example, a keyboard or any suitable multi-point touch interface 308, a pointing device 310 (e.g., a mouse). The keyboard 308 and the pointing device 310 may be coupled to the visual display device 318. The computing device 300 may include other suitable conventional I/O peripherals.

The computing device 300 may also include one or more storage devices 324, such as a hard-drive, CD-ROM, or other computer readable media, for storing data and computer-readable instructions and/or software that implement exemplary embodiments of the system 100 described herein. Exemplary storage device 324 may also store one or more databases 326 for storing any suitable information required to implement exemplary embodiments. For example, exemplary storage device 324 can store one or more databases 326 for storing information, such as data relating to user information 140, portable container information 144, combinations thereof, or the like, and computer-readable instructions and/or software that implement exemplary embodiments described herein. The databases 326 may be updated by manually or automatically at any suitable time to add, delete, and/or update one or more items in the databases.

The computing device 300 can include a network interface 312 configured to interface via one or more network devices 322 with one or more networks, for example, Local Area Network (LAN), Wide Area Network (WAN) or the Internet through a variety of connections including, but not limited to, standard telephone lines, LAN or WAN links (for example, 802.11, T1, T3, 56 kb, X.25), broadband connections (for example, ISDN, Frame Relay, ATM), wireless connections, controller area network (CAN), or some combination of any or all of the above. The network interface 312 may include a built-in network adapter, network interface card, PCMCIA network card, card bus network adapter, wireless network adapter, USB network adapter, modem or any other device suitable for interfacing the computing device 300 to any type of network capable of communication and performing the operations described herein. Moreover, the computing device 300 may be any computer system, such as a workstation, desktop computer, server, laptop, handheld computer, tablet computer (e.g., the iPad™ tablet computer), mobile computing or communication device (e.g., the iPhone™ communication device), or other form of computing or telecommunications device that is capable of communication and that has sufficient processor power and memory capacity to perform the operations described herein.

The computing device 300 may run any operating system 316, such as any of the versions of the Microsoft® Windows® operating systems, the different releases of the Unix and Linux operating systems, any version of the MacOS® for Macintosh computers, any embedded operating system, any real-time operating system, any open source operating system, any proprietary operating system, or any other operating system capable of running on the computing device and performing the operations described herein. In exemplary embodiments, the operating system 316 may be run in native mode or emulated mode. In an exemplary embodiment, the operating system 316 may be run on one or more cloud machine instances.

Figure 4:
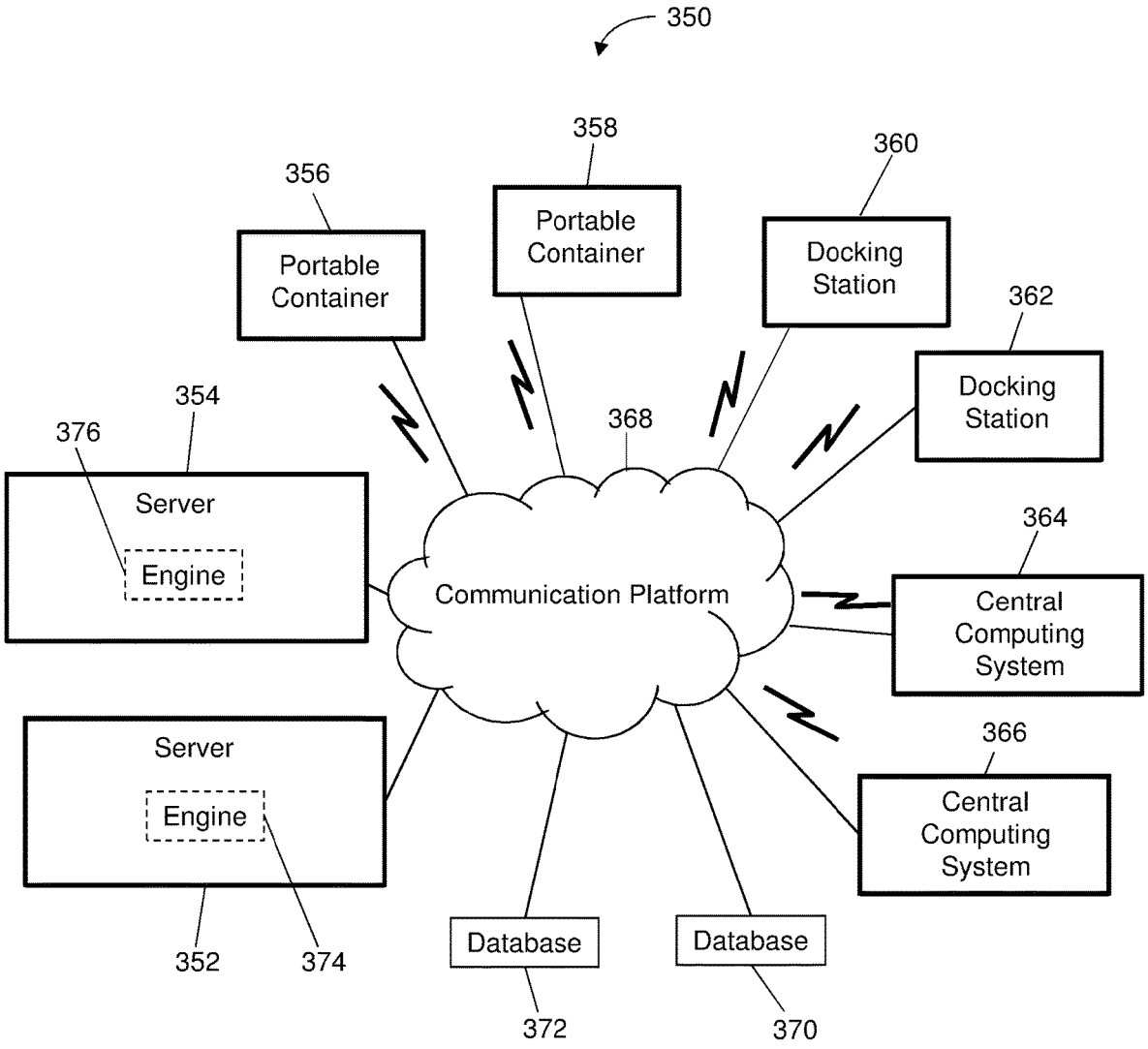
FIG. 4 is a block diagram of an exemplary portable container system environment in accordance with embodiments of the present disclosure.

FIG. 4 is an exemplary portable container system environment 350 in accordance with exemplary embodiments of the present disclosure. The environment 350 can include servers 352, 354 configured to be in communication with portable containers 356, 358, and docking stations 360, 362, via a communication platform 368, which can be any network over which information can be transmitted between devices communicatively coupled to the network. For example, the communication platform 368 can be the Internet, Intranet, virtual private network (VPN), wide area network (WAN), local area network (LAN), and the like. In some embodiments, the communication platform 368 can be part of a cloud environment. The environment 350 can include central computing systems 364, 366, which can be in communication with the servers 352, 354, as well as the portable containers 356, 358, via the communication platform 368. The environment 350 can include repositories or databases 370, 372, which can be in communication with the servers 352, 354, as well as the portable containers 356, 358 and the central computing systems 364, 366, via the communications platform 368.

In exemplary embodiments, the servers 352, 354, portable containers 356, 358, and central computing systems 364, 366, can be utilized as computing devices (e.g., computing device 300). In exemplary embodiments, the servers 252, 254, docking stations 360, 362, and central computing systems 364, 366 can utilize embodiments of the computing device 300. Those skilled in the art will recognize that the databases 370, 372 can be incorporated into one or more of the servers 352, 354 such that one or more of the servers 352, 354 can include databases 370, 372. In some embodiments, the database 370 can store the user information 140, and the database 372 can store the portable container information 144. In some embodiments, a single database 370, 372 can store both the user information 140 and the portable container information 144. In some embodiments, embodiments of the servers 352, 354 can include one or more engines 374, 376 (e.g., reservation engines 136). In some embodiments, the central computing systems 364, 366 can interface with the servers 352, 354 to execute instances of the engines 374, 376 to perform one or more processes described herein including, e.g., reserving a portable container 102.

Figure 5:
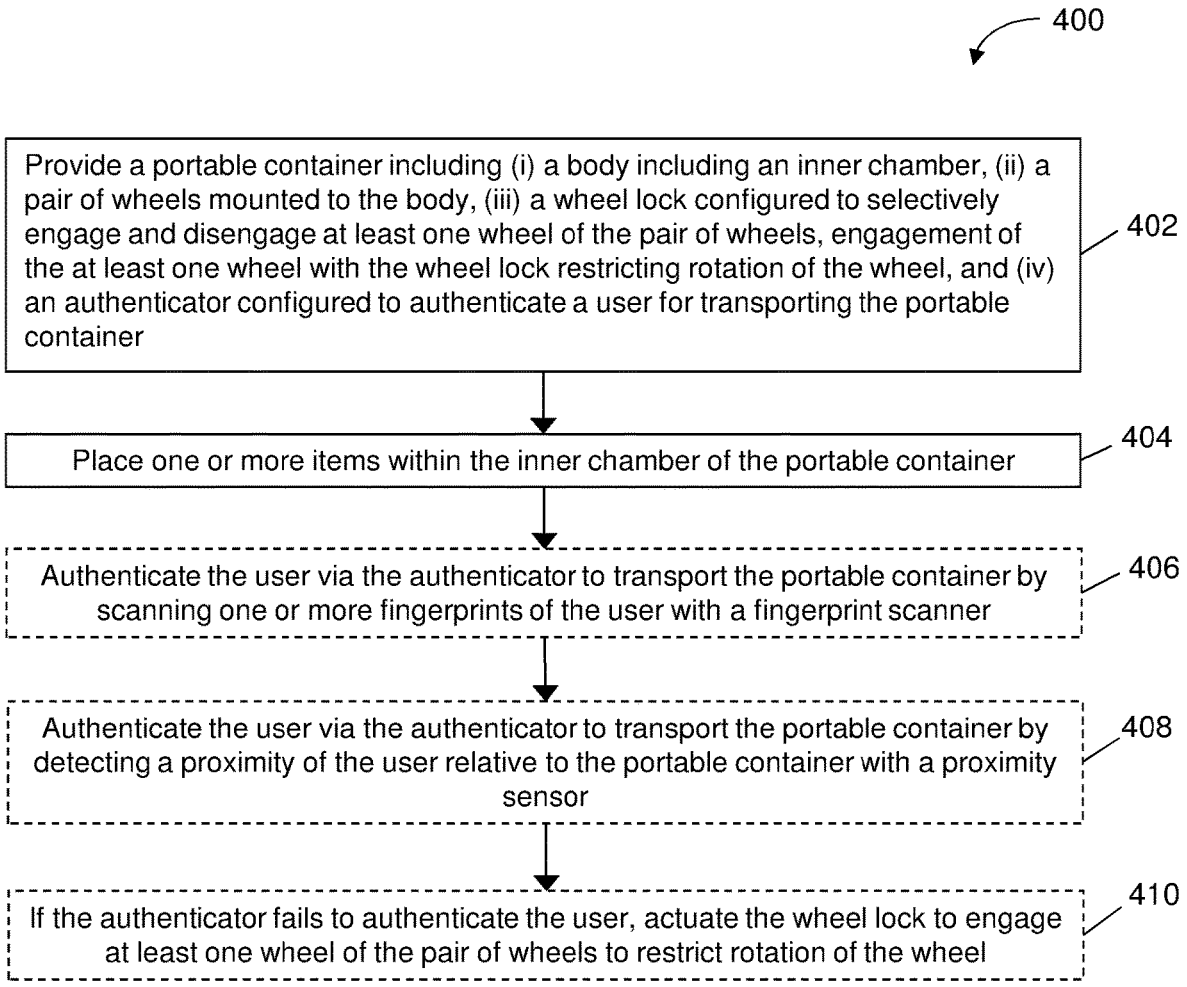
FIG. 5 is a flowchart illustrating a process implemented by an exemplary portable container in accordance with embodiments of the present disclosure.

FIG. 5 is a flowchart illustrating an exemplary process 400 as implemented by embodiments of the portable container system 100. To begin, at step 402, a portable container is provided that includes a body with an inner chamber, one or more pairs of wheels mounted to the body, a wheel lock configured to selectively engage and disengage the wheels to restrict rotation of the wheel, and an authenticator configured to authenticate a user for transporting the portable container. At step 404, one or more items are placed within the inner chamber of the portable container. In one embodiment, at step 406, the user can be authenticated via the authenticator to transport the portable container by scanning one or more fingerprints of the user with a fingerprint scanner (or scanning other biometric data with appropriate scanners). In one embodiment, at step 408, the user can be authenticated via the authenticator to transport the portable container by detecting a proximity of the user relative to the portable container with a proximity sensor. In some embodiments, a similar authentication step can occur prior to step 404 to allow the user to disengage the portable container from a docking station. At step 410, if the authenticator fails to authenticate the user, the wheel lock of the portable container can be actuated to engage at least one wheel of the pairs of wheels to restriction rotation of the wheel.

Thus, the exemplary portable containers provide a secure enclosure in which one or more items can be transported from a retail establishment to the user's home. The wheels of the portable container can be powered to assist in transporting the portable container to the desired location. In some embodiments, the amount of power or speed of rotation of the wheels can be varied by the user via controls provided on the portable container. The portable container includes an authenticator configured to authenticate the user, thereby providing a security feature that ensures that the correct user is transporting the items and preventing theft of the portable container. The authenticator also functions as a safety feature to prevent undesired motion of an unattended portable container. The temperature control system ensures that frozen items undergo minimal or no melting, or hot items undergo minimal or no cooling during transport of the items.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A portable smart locker, comprising:

a body including walls that form an inner chamber configured and dimensioned to receive one or more items;

a handle mounted to the body;

a pair of wheels mounted to the body;

a wheel lock configured to selectively engage and disengage at least one wheel of the pair of wheels, engagement of the at least one wheel with the wheel lock restricting rotation of the wheel; and an authenticator configured to authenticate a user for transporting the portable smart locker, the authenticator comprising a fingerprint scanner configured to authenticate the user by scanning one or more fingerprints of the user;

wherein the wheel lock is actuated to engage the at least one wheel of the pair of wheels to restrict rotation of the wheel when the handle is retracted into a storage compartment in a stored position;

wherein the fingerprint scanner continuously scans the one or more fingerprints of the user during use of the portable smart locker to authenticate the user; and wherein the inner chamber is separated into multiple individual inner chambers, the portable smart locker comprising a temperature control system configured to independently regulate a temperature within each of the multiple individual inner chambers of the inner chamber such that each of the multiple individual inner chambers is capable of having a different temperature environment.

2. The portable smart locker of claim 1, comprising a second pairs of wheels mounted to the body.

3. The portable smart locker of claim 1, wherein the wheel lock includes a brake configured to selectively engage and disengage the at least one wheel of the pair of wheels.

4. The portable smart locker of claim 1, wherein the handle is hingedly coupled to the body such that an angle of the handle relative to the body is adjustable depending on a height of the user.

5. The portable smart locker of claim 1, wherein if the authenticator fails to authenticate the user, the wheel lock is actuated to engage the at least one wheel of the pair of wheels to restrict rotation of the wheel.

6. The portable smart locker of claim 1, wherein the authenticator is disposed on the handle and is contoured or molded to wrap around the handle such that gripping of the authenticator by the user results in wrapping of fingers of the user around the authenticator and scanning of the fingerprints of the fingers of the user.

7. The portable smart locker of claim 1, wherein the authenticator includes a proximity sensor configured to detect a proximity of the user relative to the portable smart locker.

8. The portable smart locker of claim 7, wherein the proximity sensor is configured to detect the proximity of a handheld device of the user relative to the portable smart locker.

9. The portable smart locker of claim 1, comprising a power source configured to rotationally power the pair of wheels.

10. The portable smart locker of claim 9, comprising an actuator for selectively rotationally powering the pair of wheels with the power source.

11. The portable smart locker of claim 9, wherein the pair of wheels are automatically rotationally powered by the power source upon successful authentication of the user with the authenticator.

12. A method of transporting items, comprising:

providing a portable smart locker, the portable smart locker including:

a body including walls that form an inner chamber;

a handle mounted to the body;

a pair of wheels mounted to the body;

a wheel lock configured to selectively engage and disengage at least one wheel of the pair of wheels, engagement of the at least one wheel with the wheel lock restricting rotation of the wheel; and an authenticator configured to authenticate a user for transporting the portable smart locker, the authenticator comprising a fingerprint scanner;

authenticating the user via the authenticator to transport the portable smart locker by continuously scanning one or more fingerprints of the user with the fingerprint scanner during use of the portable smart locker;

actuating the wheel lock to engage the at least one wheel of the pair of wheels to restrict rotation of the wheel when the handle is retracted into a storage compartment in a stored position; and wherein the inner chamber is separated into multiple individual inner chambers, the portable smart locker comprising a temperature control system configured to independently regulate a temperature within each of the multiple individual inner chambers of the inner chamber such that each of the multiple individual inner chambers is capable of having a different temperature environment.

13. The method of claim 12, wherein if the authenticator fails to authenticate the user, the wheel lock is actuated to engage the at least one wheel of the pair of wheels to restrict rotation of the wheel.

14. The method of claim 12, wherein the authenticator includes a proximity sensor, the method comprising authenticating the user by detecting a proximity of the user relative to the portable smart locker.

* * * * *